US007836862B2

(12) United States Patent
Shi et al.

(10) Patent No.: US 7,836,862 B2
(45) Date of Patent: Nov. 23, 2010

(54) SYSTEMS AND METHODS FOR PREDICTING ENGINE DELTA FRICTION TORQUE USING BOTH COOLANT AND OIL TEMPERATURE

(75) Inventors: Fanghui Shi, Rochester Hills, MI (US); Chandrashekar Joshi, Bangalore (IN); Annette Cusenza, Grosse Pointe Shores, MI (US); Rohit S. Paranjpe, Rochester Hills, MI (US)

(73) Assignee: GM Global Technology Operations, Inc.

( * ) Notice: Subject to any disclaimer, the term of this patent is extended or adjusted under 35 U.S.C. 154(b) by 312 days.

(21) Appl. No.: 12/176,553

(22) Filed: Jul. 21, 2008

(65) Prior Publication Data

US 2009/0259384 A1 Oct. 15, 2009

Related U.S. Application Data

(60) Provisional application No. 61/044,179, filed on Apr. 11, 2008.

(51) Int. Cl.
*F02D 31/00* (2006.01)
*F02P 9/00* (2006.01)

(52) U.S. Cl. ..... 123/339.24; 123/335; 123/435

(58) Field of Classification Search ..... 123/435, 123/568.21, 339.1, 339.24, 335; 701/108, 701/111

See application file for complete search history.

(56) References Cited

U.S. PATENT DOCUMENTS

| | | | | |
|---|---|---|---|---|
| 6,341,535 | B1 * | 1/2002 | Yasui | 73/862.333 |
| 7,272,487 | B2 * | 9/2007 | Christen et al. | 701/108 |
| 2002/0112472 | A1 * | 8/2002 | Tashiro et al. | 60/295 |
| 2005/0188953 | A1 * | 9/2005 | Ishikawa et al. | 123/339.11 |

* cited by examiner

*Primary Examiner*—John T Kwon

(57) ABSTRACT

An engine control system comprises a coolant temperature weighting module that generates a weighting signal based on coolant temperature. A composite temperature generating module generates a composite temperature based on the coolant temperature, an oil temperature and the weighting signal. A delta friction torque module calculates delta friction torque of an engine based on the composite temperature. An engine operating parameter module that adjusts an engine operating parameter based on the delta friction torque.

10 Claims, 3 Drawing Sheets

SYSTEMS AND METHODS FOR PREDICTING ENGINE DELTA FRICTION TORQUE USING BOTH COOLANT AND OIL TEMPERATURE

CROSS-REFERENCE TO RELATED APPLICATIONS

This application claims the benefit of U.S. Provisional Application No. 61/044,179, filed on Apr. 11, 2008, which is incorporated herein by reference in its entirety.

FIELD

The present disclosure relates to engine control systems and methods, and more particularly to engine control systems and methods for predicting engine delta friction torque.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

During engine calibration, a correction to engine torque may be performed to compensate for delta friction torque due to temperature and/or engine speed. Some engine control systems use a look-up table of engine speed and oil temperatures to determine a delta friction torque.

SUMMARY

An engine control system comprises a coolant temperature weighting module that generates a weighting signal based on coolant temperature. A composite temperature generating module generates a composite temperature based on the coolant temperature, an oil temperature and the weighting signal. A delta friction torque module calculates delta friction torque of an engine based on the composite temperature. An engine operating parameter module adjusts an engine operating parameter based on the delta friction torque.

In other features, the coolant temperature weighting module generates the weighting signal based on:

$$W=(1-\tan h((T_{cool}-60)*0.012))/2$$

where W is the weighting signal and $T_{cool}$ is the coolant temperature.

In other features, the composite temperature generating module generates the composite temperature based on:

$$T_c=W*T_{cool}+(1-W)*T_{oil}$$

wherein $T_c$ is the composite temperature, $T_{cool}$ is the coolant temperature, $T_{oil}$ is the oil temperature and W is the weighting signal.

In other features, the delta friction torque module calculates the delta friction torque based on:

$$T_{DF}=A*T_c^2+B*T_c+C$$

where the delta friction torque is $T_{DF}$, A, B and C are constants and $T_c$ is the composite temperature.

In other features, the delta friction torque module sets the delta friction torque to a constant when the composite temperature is greater than a composite temperature threshold.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
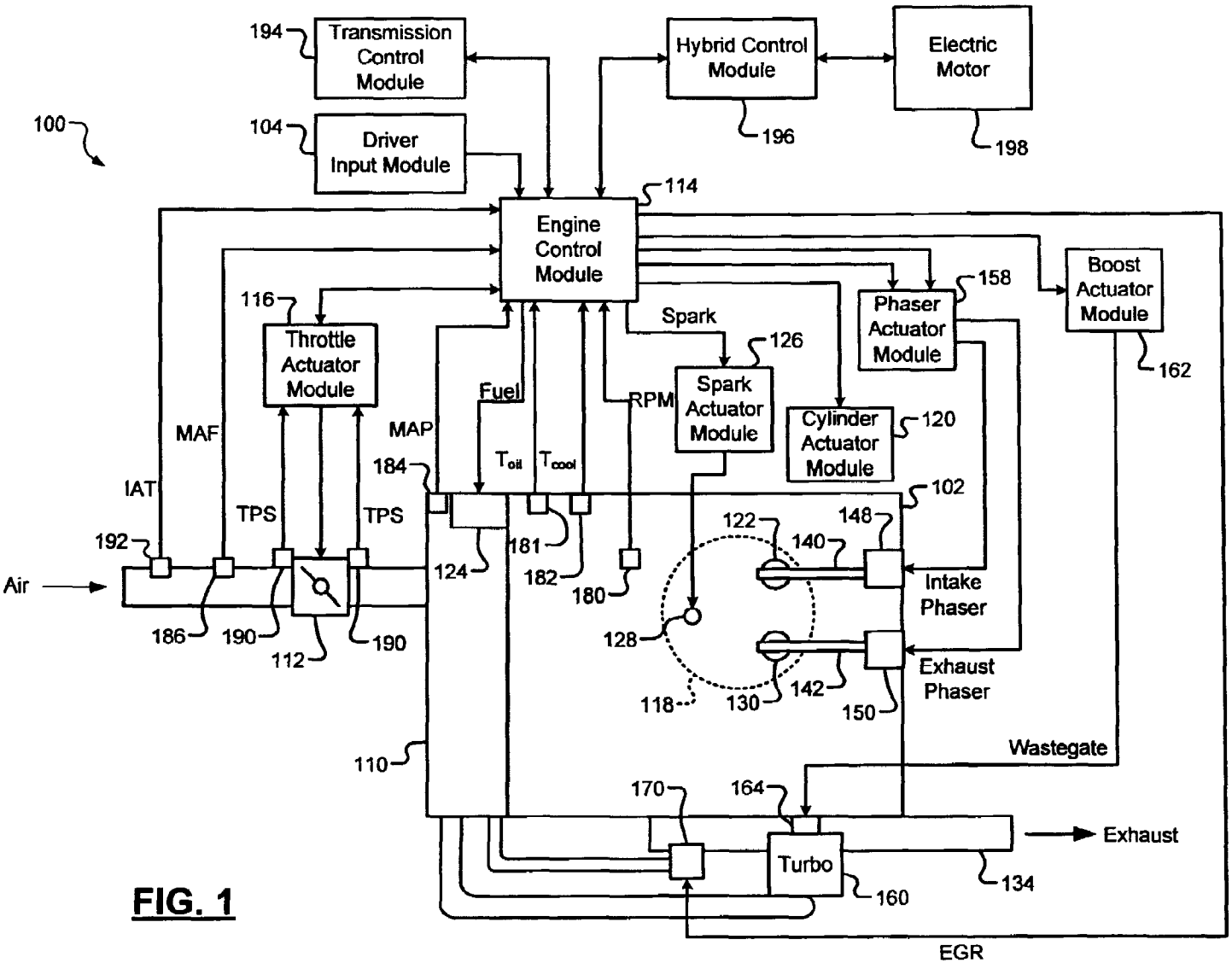
FIG. 1 is a functional block diagram of an engine control system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure. As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Conventional systems and methods for predicting delta friction torque $T_{DF}$ do not take into account coolant temperature $T_{cool}$, which in addition to oil temperature $T_{oil}$, tends to affect the delta friction torque $T_{DF}$, particularly at low coolant temperatures. Therefore, the present disclosure provides an accurate prediction of delta friction torque $T_{DF}$ at cold temperatures based on coolant temperature $T_{cool}$.

The present disclosure introduces an empirical equation for the engine delta friction torque $T_{DF}$ as a function of composite temperature $T_C$. The composite temperature $T_C$ is based on coolant temperature, oil temperature and a weighting function. Using these equations can improve the accuracy of delta friction torque prediction, especially at low coolant temperatures.

The present disclosure discloses a set of equations that are used in an engine control module to predict engine delta friction torque $T_{DF}$ as a function of composite temperature $T_c$.

The composite temperature $T_C$ is calculated based on the coolant temperature $T_{cool}$, and an oil temperature $T_{oil}$. For example, a coolant temperature sensor may be arranged in the engine block in fluid communication with the coolant. For example, an oil temperature sensor may be arranged in the engine gallery or sump in fluid communication with the oil. Alternately, the coolant temperature and/or oil temperature may be estimated.

The composite temperature $T_C$ is calculated using a weighting function and a composite temperature function. For example only, the composite temperature function may be:

$$T_c = W*T_{cool} + (1-W)*T_{oil}$$

and the weighting function may be:

$$W = (1 - \tan h((T_{cool} - 60)*0.012))/2$$

The delta friction torque may then be obtained using the following relationship:

$$T_{DF} = A*T_c^2 + B*T_c + C$$

where A, B and C are constants.

In some situations, the delta friction torque may be set equal to a constant such as zero above a predetermined composite temperature threshold $T_{c_TH}$. For example only, the predetermined composite temperature threshold $T_{c_TH}$ may be set equal to 100° Celsius.

Referring now to FIG. 1, a functional block diagram of an exemplary engine system 100 is presented. While the present disclosure will be described in conjunction with this exemplary engine, skilled artisans will appreciate the teachings of the present disclosure may be applied to any engine control system.

For example only, the engine system 100 includes an engine 102 that combusts an air/fuel mixture to produce drive torque for a vehicle based on a driver input module 104. Air is drawn into an intake manifold 110 through a throttle valve 112. An engine control module (ECM) 114 commands a throttle actuator module 116 to regulate opening of the throttle valve 112 to control the amount of air drawn into the intake manifold 110.

Air from the intake manifold 110 is drawn into cylinders of the engine 102. While the engine 102 may include multiple cylinders, for illustration purposes, a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders to improve fuel economy.

Air from the intake manifold 110 is drawn into the cylinder 118 through an intake valve 122. The ECM 114 controls the amount of fuel injected by a fuel injection system 124. The fuel injection system 124 may inject fuel into the intake manifold 110 at a central location or may inject fuel into the intake manifold 110 at multiple locations, such as near the intake valve of each of the cylinders. Alternatively, the fuel injection system 124 may inject fuel directly into the cylinders.

The injected fuel mixes with the air and creates the air/fuel mixture in the cylinder 118. A piston (not shown) within the cylinder 118 compresses the air/fuel mixture. Based upon a signal from the ECM 114, a spark actuator module 126 energizes a spark plug 128 in the cylinder 118, which ignites the air/fuel mixture. The timing of the spark may be specified relative to the time when the piston is at its topmost position, referred to as top dead center (TDC), the point at which the air/fuel mixture is most compressed.

The combustion of the air/fuel mixture drives the piston down, thereby driving a rotating crankshaft (not shown). The piston then begins moving up again and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts may control multiple intake valves per cylinder and/or may control the intake valves of multiple banks of cylinders. Similarly, multiple exhaust camshafts may control multiple exhaust valves per cylinder and/or may control exhaust valves for multiple banks of cylinders. The cylinder actuator module 120 may deactivate cylinders by halting provision of fuel and spark and/or disabling their exhaust and/or intake valves.

The time when the intake valve 122 is opened may be varied with respect to piston TDC by an intake cam phaser 148. The time when the exhaust valve 130 is opened may be varied with respect to piston TDC by an exhaust cam phaser 150. A phaser actuator module 158 controls the intake cam phaser 148 and the exhaust cam phaser 150 based on signals from the ECM 114.

The engine system 100 may include a boost device that provides pressurized air to the intake manifold 110. For example, FIG. 1 depicts a turbocharger 160. The turbocharger 160 is powered by exhaust gases flowing through the exhaust system 134, and provides a compressed air charge to the intake manifold 110. The air used to produce the compressed air charge may be taken from the intake manifold 110.

A wastegate 164 may allow exhaust gas to bypass the turbocharger 160, thereby reducing the turbocharger's output (or boost). The ECM 114 controls the turbocharger 160 via a boost actuator module 162. The boost actuator module 162 may modulate the boost of the turbocharger 160 by controlling the position of the wastegate 164. The compressed air charge is provided to the intake manifold 110 by the turbocharger 160. An intercooler (not shown) may dissipate some of the compressed air charge's heat, which is generated when air is compressed and may also be increased by proximity to the exhaust system 134. Alternate engine systems may include a supercharger that provides compressed air to the intake manifold 110 and is driven by the crankshaft.

The engine system 100 may include an exhaust gas recirculation (EGR) valve 170, which selectively redirects exhaust gas back to the intake manifold 110. In various implementations, the EGR valve 170 may be located after the turbocharger 160. The engine system 100 may measure the speed of the crankshaft in revolutions per minute (RPM) using an RPM sensor 180. The temperature of the oil may be measured using an oil temperature sensor 181. The temperature of the engine coolant may be measured using an engine coolant temperature (ECT) sensor 182. Alternately, one or both of the coolant temperature and oil temperature may be estimated. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum may be measured, where engine vacuum is the difference between ambient air pressure and the pressure within the intake manifold 110. The mass of air flowing into the intake manifold 110 may be measured using a mass air flow (MAF) sensor 186. In various implementations, the MAF sensor 186 may be located in a housing with the throttle valve 112.

The throttle actuator module 116 may monitor the position of the throttle valve 112 using one or more throttle position sensors (TPS) 190. The ambient temperature of air being drawn into the engine system 100 may be measured using an intake air temperature (IAT) sensor 192. The ECM 114 may use signals from the sensors to make control decisions for the engine system 100.

The ECM 114 may communicate with a transmission control module 194 to coordinate shifting gears in a transmission (not shown). For example, the ECM 114 may reduce torque during a gear shift. The ECM 114 may communicate with a hybrid control module 196 to coordinate operation of the engine 102 and an electric motor 198. The electric motor 198 may also function as a generator, and may be used to produce electrical energy for use by vehicle electrical systems and/or for storage in a battery. In various implementations, the ECM 114, the transmission control module 194, and the hybrid control module 196 may be integrated into one or more modules.

To abstractly refer to the various control mechanisms of the engine 102, each system that varies an engine parameter may be referred to as an actuator. For example, the throttle actuator module 116 can change the blade position, and therefore the opening area, of the throttle valve 112. The throttle actuator module 116 can therefore be referred to as an actuator, and the throttle opening area can be referred to as an actuator position.

Similarly, the spark actuator module 126 can be referred to as an actuator, while the corresponding actuator position is amount of spark advance. Other actuators include the boost actuator module 162, the EGR valve 170, the phaser actuator module 158, the fuel injection system 124, and the cylinder actuator module 120. The term actuator position with respect to these actuators may correspond to boost pressure, EGR valve opening, intake and exhaust cam phaser angles, air/fuel ratio, and number of cylinders activated, respectively.

Figure 2:
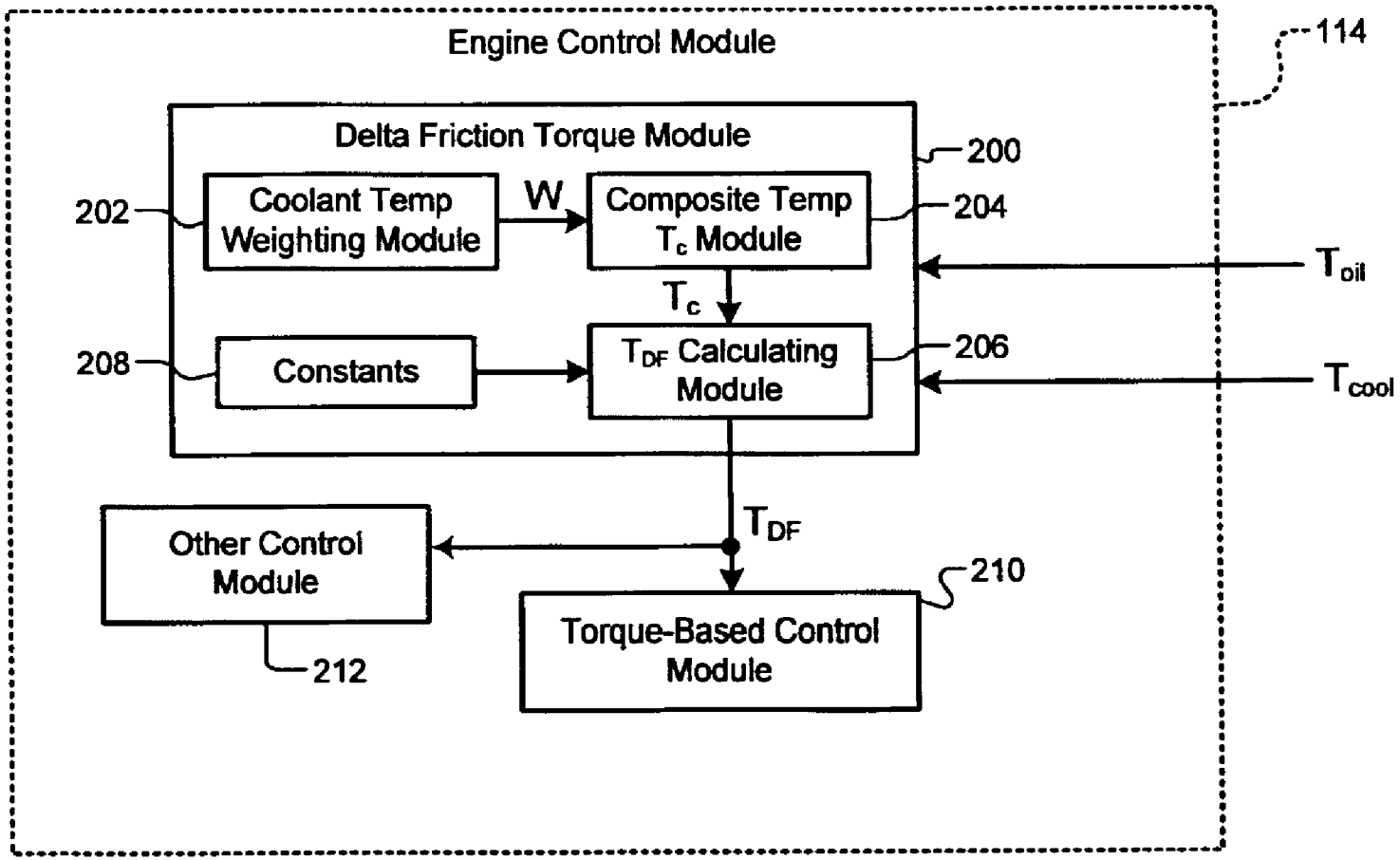
FIG. 2 is a functional block diagram of an exemplary engine control module with a delta friction torque module according to the present disclosure.

Referring now to FIG. 2, the engine control module 114 may comprise a delta friction torque module 200 that receives, estimates or otherwise obtains the oil temperature $T_{oil}$ and the coolant temperature $T_{cool}$. A coolant temperature $T_{cool}$ weighting module 202 generates a coolant weighting signal W. For example only, the coolant weighting signal may be based on $W=(1-\tan h((T_{cool}-60)*0.012))/2$.

A composite temperature module 204 generates a composite temperature signal $T_c$ based on the weighting function, the coolant temperature $T_{cool}$ and the oil temperature $T_{oil}$. For example only, the composite temperature $T_c$ may be based on $T_c=W*T_{cool}+(1-W)*T_{oil}$.

A delta friction torque calculating module 206 generates delta friction torque $T_{DF}$ for the engine. For example only, the delta friction torque $T_{DF}$ can be based on:

$$T_{DF}=A*T_c^2+B*T_c+C$$

where A, B and C are constants. A storing module 208 may store the constants. The constants 208 may include $T_{c_TH}$, A, B and C. The delta friction torque module 200 outputs the delta friction torque $T_{DF}$ as further described herein.

For example only, the delta friction torque $T_{DF}$ can be output to a torque-based control system 210 or other control module 212. The torque-based control system 210 or other control module 212 may adjust an engine operating parameter based on the delta friction torque $T_{DF}$. For example only, torque of another actuator or torque supplier can be reduced or increased based on the delta friction torque $T_{DF}$ to compensate for delta friction torque $T_{DF}$.

Figure 3:
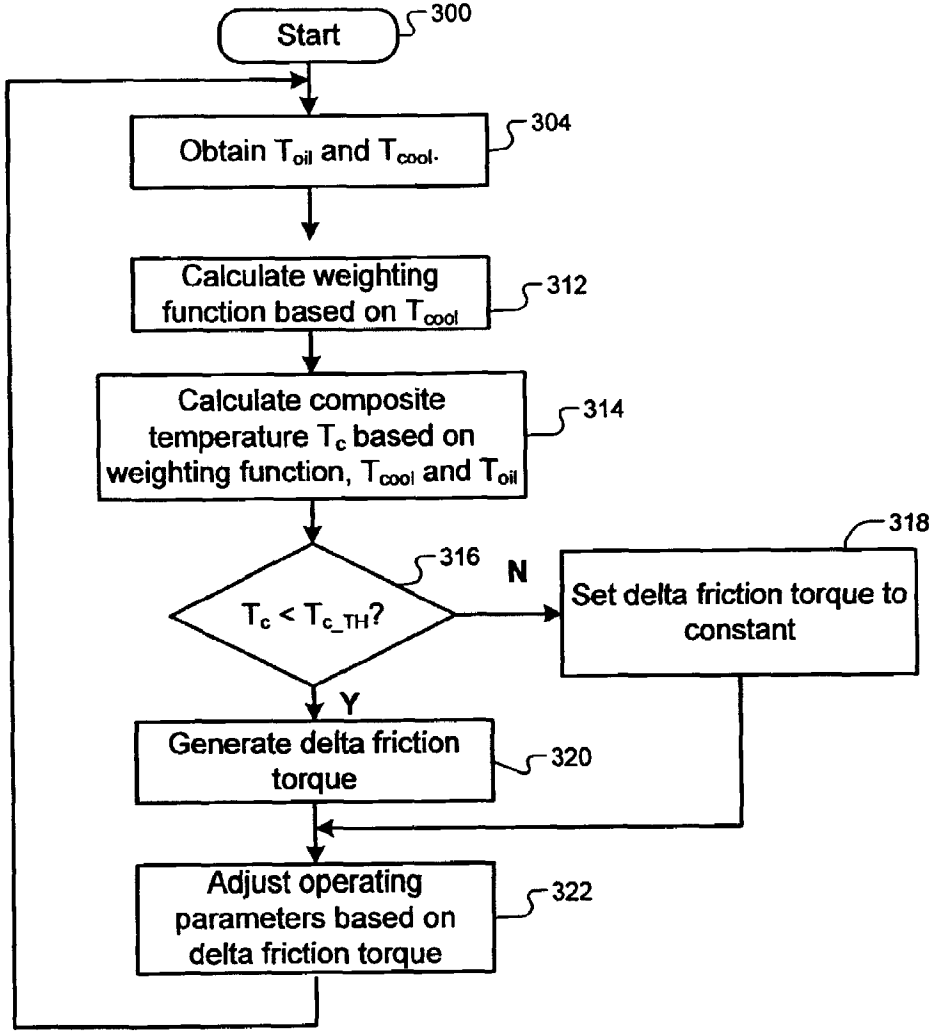
FIG. 3 illustrates steps of a method for calculating delta friction torque according to the present disclosure.

Referring now to FIG. 3, steps of a method for estimating delta friction torque $T_{DF}$ is shown. Control begins in step 300. In step 304, control obtains $T_{oil}$ and $T_{cool}$ by measuring, estimating and/or another approach. In step 312, control calculates the weighting signal W based on $T_{cool}$. In step 314, control calculates the composite temperature $T_c$ based on the weighting function W, $T_{cool}$ and $T_{oil}$. In step 316, control determines whether $T_c$ is less than $T_{c_TH}$. If step 316 is false, control continues with step 318 and sets delta friction torque $T_{DF}$ equal to a constant such as zero. If step 316 is true, control calculates the delta friction torque $T_{DF}$ in step 320 based on the constants A, B and C and the composite temperature $T_c$. Control continues from steps 318 and 320 with step 322 and one or more engine operating parameters are adjusted based on delta friction torque $T_{DF}$.

For example only, the delta friction torque $T_{DF}$ can be obtained using a universal curve for all engines where:

$$T_{DF}=0.003444920*T_c^2-0.678696783*T_c+33.823912368$$

Alternately, specific formulas may be developed for specific engine families. In other words, the constants A, B, and C can be determined for a particular engine.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system, comprising:

a coolant temperature weighting module that generates a weighting signal based on coolant temperature;

a composite temperature generating module that generates a composite temperature based on said coolant temperature, an oil temperature and said weighting signal;

a delta friction torque module that calculates delta friction torque of an engine based on said composite temperature; and an engine operating parameter module that adjusts an engine operating parameter based on said delta friction torque.

2. The engine control system of claim 1 wherein said coolant temperature weighting module generates said weighting signal based on:

$$W=(1-\tan h((T_{cool}-60)*0.012))/2$$

where W is said weighting signal and $T_{cool}$ is said coolant temperature.

3. The engine control system of claim 1 wherein said composite temperature generating module generates said composite temperature based on:

$$T_c=W*T_{cool}+(1-W)*T_{oil}$$

wherein $T_c$ is said composite temperature, $T_{cool}$ is said coolant temperature, $T_{oil}$ is said oil temperature and W is said weighting signal.

4. The engine control system of claim 1 wherein said delta friction torque module calculates said delta friction torque based on:

$$T_{DF}=A*T_c^2+B*T_c+C$$

where said delta friction torque is $T_{DF}$, A, B and C are constants and $T_c$ is said composite temperature.

5. The engine control system of claim 1 wherein said delta friction torque module sets said delta friction torque to a constant when said composite temperature is greater than a composite temperature threshold.

6. A method for operating an engine comprising:

generating a weighting signal based on a coolant temperature;

generating a composite temperature based on said coolant temperature, an oil temperature and said weighting signal;

calculating delta friction torque of an engine based on said composite temperature; and adjusting an engine operating parameter based on said delta friction torque.

7. The engine control system of claim 6 wherein said weighting signal is based on:

$$W=(1-\tan h((T_{cool}-60)*0.012))/2$$

where W is said weighting signal and $T_{cool}$ is said coolant temperature.

8. The engine control system of claim 6 wherein said composite temperature is based on:

$$T_c=W*T_{cool}+(1-W)*T_{oil}$$

wherein $T_c$ is said composite temperature, $T_{cool}$ is said coolant temperature, $T_{oil}$ is said oil temperature and W is said weighting signal.

9. The engine control system of claim 6 wherein said delta friction torque is based on:

$$T_{DF}=A*T_c^2+B*T_c+C$$

where said delta friction torque is $T_{DF}$, A, B and C are constants and $T_c$ is said composite temperature.

10. The engine control system of claim 6 further comprising setting said delta friction torque to a constant when said composite temperature is greater than a composite temperature threshold.

* * * * *